United States Patent [19]

Landwehrkamp

[11] Patent Number: 4,663,930

[45] Date of Patent: May 12, 1987

[54] OPEN-END SPINNING ROTOR AND PROCESS FOR PRODUCING SAME

[75] Inventor: Hans Landwehrkamp, Lenting, Fed. Rep. of Germany

[73] Assignee: Schubert & Salzer, Ingolstadt, Fed. Rep. of Germany

[21] Appl. No.: 763,407

[22] Filed: Aug. 7, 1985

[30] Foreign Application Priority Data

Aug. 8, 1984 [DE] Fed. Rep. of Germany ..... 3429132

[51] Int. Cl.[4] ..... D01H 7/885; D01H 1/135

[52] U.S. Cl. ..... 57/416; 29/455 R; 29/463; 29/DIG. 48; 57/414

[58] Field of Search ..... 57/400, 404, 414, 415, 57/416, 417; 29/406, 445, 455 R, 463, 469, 527.1, DIG. 38, DIG. 48

[56] References Cited

U.S. PATENT DOCUMENTS

| | | | |
|---|---|---|---|
| 1,586,691, | 6/1926 | Murray, Jr. | 29/463 X |
| 3,339,360 | 9/1967 | Mikulecky et al. | 57/414 |
| 3,439,487 | 4/1969 | Landwehrkamp et al. | 57/414 |
| 4,193,253 | 3/1980 | Herbert et al. | 57/414 |
| 4,319,449 | 3/1982 | Hofmann | 57/414 |
| 4,339,911 | 7/1982 | Hofmann | 57/416 |
| 4,492,077 | 1/1985 | Raasch et al. | 57/416 X |
| 4,561,476 | 12/1985 | Bunkoczy | 29/463 X |
| 4,590,652 | 5/1986 | Harwood | 29/DIG. 48 |

*Primary Examiner*—John Petrakes
*Attorney, Agent, or Firm*—Dority & Manning

[57] ABSTRACT

In an open-end spinning rotor comprising two separately-formed rotor parts subsequently connected to one another, a parting gap between the two rotor parts opens into the fiber-collecting groove and is formed at least partially as a weld seam connecting the two rotor parts. At least part of the fiber-collecting groove may be formed by an insert ring to increase the wear-resistance of the groove. The ring, adjoining a sliding wall of the upper rotor part, is clamped between the two rotor parts and thereby radially inwards limits the parting gap inwards. To produce one of the present open-end spinning rotors, during welding the two rotor parts are so arranged relative to the welding location and rotated past the latter that the weld seam forms on the outside of the spinning rotor and does not project into the fiber-collecting groove.

20 Claims, 8 Drawing Figures

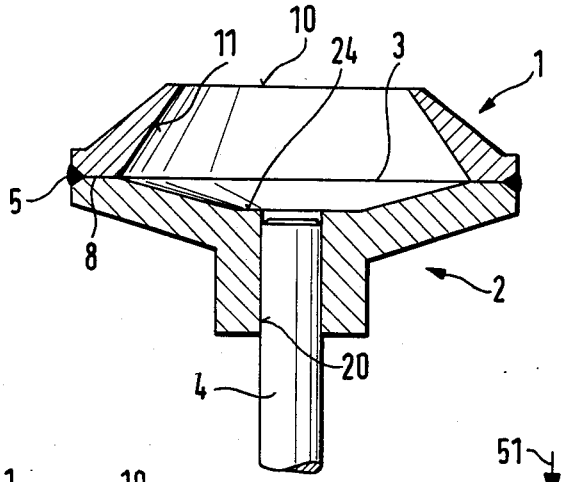
FIG. 1
FIG. 2
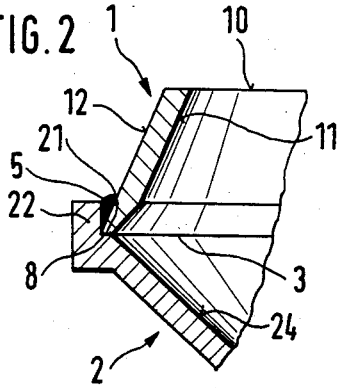
FIG. 3
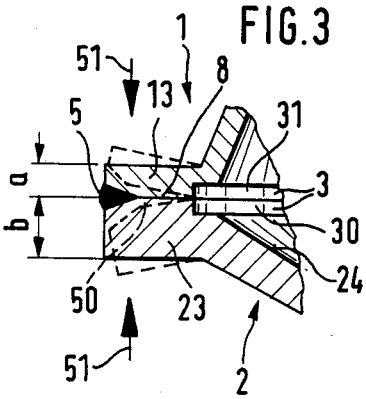
FIG. 4
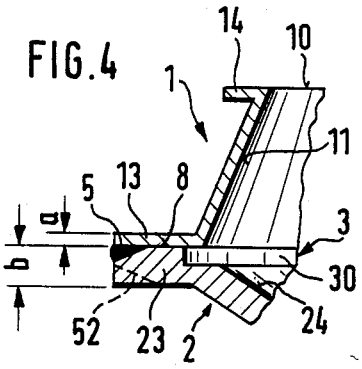
FIG. 5
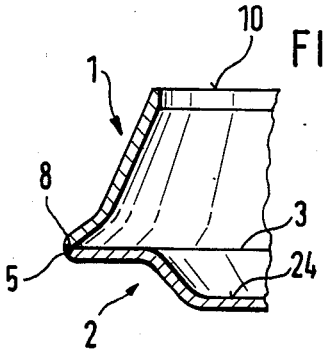

OPEN-END SPINNING ROTOR AND PROCESS FOR PRODUCING SAME

BACKGROUND AND SUMMARY OF THE INVENTION

The present invention relates in part to an open-end spinning rotor having a fiber-collecting groove, which rotor comprises two rotor parts connected to one another, and to a process for producing such a rotor as herewith disclosed.

Open-end spinning rotors are conventionally made in one piece. However, for various reasons, it is also known to produce multi-part open-end spinning rotors. It is possible in this way to produce even complicated rotor shapes more simply and more economically than by forming one-piece open-end spinning rotors.

To permit a spinning rotor to be cleaned pneumatically, it may be divided, for example, in the region of a fiber-collecting groove (Swiss Patent Specification No. 458,216 and German Offenlegungsschrift No. 2,103,171). The two rotor parts can be removed from one another so that fibers and yarn remains can be sucked off radially between the two rotor parts.

Because of the play necessary to ensure requisite movability, there is a danger that fibers and dirt constituents will be jammed between the movable parts. There is also the danger that the interacting surfaces of the fiber-collecting groove will in time be affected by movements and constituents possibly jammed inside to the detriment of perfect yarn formation.

Apart from the fact that the production of multi-part spinning rotors can enable break-down cleaning of the spinning rotors, the production of multi-part spinning rotors of this type is usually to avoid the necessity of having to turn spinning rotors on a lathe from a solid body (as in German Offenlegungsschrift No. 2,058,340). Another object may be to manufacture simple parts when the open-end spinning rotor itself may have a relatively complex shape to generate the necessary operating vacuum (as in German Offenlegungsschrift No. 2,058,340 and German Auslegeschrift 2,159,248).

In such a case, a sliding wall and a fiber-collecting groove are provided in a first rotor part, and a fan is provided on another rotor part. The two rotor parts are then connected to one another via connecting bolts or directly by means of a press fit.

It has also been proposed to produce multi-part spinning rotors, with one rotor part specially designed according to necessary spinning properties, while the other rotor part is designed to meet required strength properties. In such instances, the two rotor parts are connected to one another by means of an engagement or adhesive connection or by means of a shrink-on sleeve (as in German Patent Specification Nos. 2,939,325 and 2,939,326).

In both of the foregoing cases, the parting gap between the two individual parts constituting the spinning rotor is not located in the region of the collecting groove since any loosening of this connection between these individual parts results in an irregular fiber-collecting groove and consequently also in uneven yarn.

All these various attempts have nevertheless failed, since they cannot be put into effect economically or in a practical way in industrial production. Open-end spinning rotors produced in such ways either are incapable of spinning or do not withstand the high speeds required.

One object of the present invention is to provide a method of producing in a simple and economical way a serviceable open-end spinning rotor which is capable of spinning and which comprises several rotor parts.

According to this invention, this and other objects may be achieved with a parting gap between the rotor parts which opens into a fiber-collecting groove, and is formed at least partially as a weld seam. Before being connected, the separate rotor parts are produced and machined completely independently of one another. Since the parting gap opens into the fiber-collecting groove, the groove is easily accessible before connection. This ensures a high degree of universality and flexibility in the production of open-end spinning rotors and even enables the formation of extreme forms of the fiber-collecting groove, e.g., undercut, unusually deep or very acute-angled fiber-collecting grooves.

The joining of the two rotor parts by means of a weld seam guarantees a secure wear-resistant connection between the two rotor parts. At the same time, and if appropriate for a given situation, the rotor parts may be held against one another under prestress. Such a connection between two rotor parts is thereby reliably prevented from working loose, thus also excluding the possibility that fibers and dirt will be jammed in the parting gap.

In principle, the parting gap can assume a wide variety of forms, e.g., cylinder or cone shell, but a parting gap opening radially into the weld seam is particuarly advantageous in terms of production and also for most intended uses.

According to one preferred embodiment of this invention, each of the two rotor parts has a flange, and the parting gap is located between these flanges. As a result, the spinning rotor can be formed with very thin walls so as to achieve as low a power consumption (i.e., power input requirement for rotation) as possible. This is because the flanges ensure that the spininng rotor has good dynamic (rotational) stability even at high speeds.

In another preferred embodiment of this invention, the wall thickness of the flange for the rotor part which constitutes the rotor bottom is formed greater than the wall thickness of the rotor part which accomodates a sliding wall. At the same time, the flange with the thicker cross-section not only fulfills the purpose of ensuring that the spinning rotor has dynamic stability even at high rotational speeds, but permits the milling off of material at that point for balancing, without weakening the cross-section of the actual spinning rotor and thereby reducing its dynamic stability.

The connection between the two rotor parts by means of a weld seam also guarantees, long term, that the parting gap will remain sufficiently narrow that no fibers and no dirt can become stuck there. To press the two rotor parts against one another with particular firmness during connection, the parting gap is appropriately limited by surfaces of the flanges which are nonparallel relative to one another in the unconnected state. In the connected state, the edges of the flanges facing the fiber-collecting groove are held against one another under prestress by means of the weld seam.

To obtain a shaped fiber-collecting groove in a simple way without any cutting, the fiber-collecting groove is preferably formed as an angular annular slot which is produced as a result of stamping of at least one of the two rotor parts. As a result of this stamping, the stamped surface is compressed and its wearing resistance consequently increased, without the surface structure being changed thereby.

Alternatively, in order to increase the wearing resistance of the fiber-collecting groove even further, at least part of the groove may be formed by an insert ring which is clamped adjoining the sliding wall and between the two rotor parts so as to limit the parting gap radially inwards. The advantage of such an insert ring is that it may comprise a material chosen independently of the material which comprises the remaining spinning rotor. To ensure a high wearing resistance, the insert ring preferably comprises a ceramic material.

Annular insert rings forming at least part of one fiber-collecting groove are to an extent known (German Utility Models Nos. 7,622,639 and 7,622,656). With such spinning rotors, the insert ring must extend up to the open end of the spinning rotor, with the result that the weight of the spinning rotor becomes very great. It therefore also consumes a large amount of energy during its operation.

In contrast, the present invention makes it possible to restrict the insert ring solely to the region of the fiber-collecting groove. The insert ring in this invention then may comprise a material, for example ceramic, differing from that of the remaining region of the fiber-collecting surface, and especially differing from the sliding wall of the spinning rotor.

The insert ring of this invention can perform differing functions and may therefore also take on differing forms accordingly. If it is desired for the insert ring to only perform the function of guaranteeing the depth of the fiber-collecting groove over a long term, then the two rotor parts may be advantageously provided with coaxial annular slots aligned with one another for accomodating the insert ring.

An insert ring forming at least part of the fiber-collecting groove is preferably profiled on its inner periphery. In this way, the insert ring comprises not only the bottom of the fiber-collecting groove, but also its side walls, thus increasing the dynamic stability of the fiber-collecting groove and consequently the spinning properties of the rotor over a long period of time.

So that the fiber-collecting groove may be given any desired form when an insert ring is used, in a further embodiment of this invention the insert ring may comprise a two part ring with the respective parts against one another in the region of their largest inside diameter.

The open-end spinning rotor is preferably made from sheet metal by means of plastic shaping. In such a case, the insert ring may likewise comprise profiled sheet metal which is held against the rotor parts under prestress by means of the rotor parts connected to one another.

In accordance with one aspect of this invention, to produce an open-end spinning rotor of this type, the two rotor parts are connected to one another by means of welding, the rotor parts being arranged relative to the welding location and rotated past the latter such that the weld seam forms on the outside of the open-end spinning rotor and does not project into the fiber-collecting groove. A fiber-collecting groove of any desired form can thereby be produced in a simple way, without its form being adversely affected when the rotor parts are joined together. Consequently, there are also no disadvantageous effects on the fibers during spinning.

The two rotor parts may be advantageously pressed against one another during the welding operation.

Particularly light-weight open-end spinning rotors can be obtained, in accordance with the invention, if at least the rotor part accomodating the sliding wall for the fibers is produced by means of non-cutting shaping, with the fiber-collecting groove acquiring its shape as a result of stamping.

To increase the strength of the fiber-collecting groove, in a further aspect of the process according to this invention, the two rotor parts receive in the region where subsequently their fiber-collecting groove will be formed recesses into which (when the two rotor parts are joined together) is inserted an insert ring. The ring is secured in this position as a result of the welding of the two rotor parts to one another.

By producing rotors in accordance with this invention, the above-described disadvantages of the prior art are avoided. Furthermore, an open-end spinning rotor according to this invention can be produced in a simple way and by simple means. Because of the many possible modifications of a rotor's fiber-collecting surface within the scope of this invention, the rotor can be used universally. Even the most extreme forms of a rotor can be produced without difficulty and without time-consuming measures. Moreover, the open-end spinning rotor is dynamically (dimensionally) stable and wear-resistant while at the same time possessing a low power consumption characteristic.

BRIEF DESCRIPTION OF THE DRAWINGS

This invention is explained in further detail below, with reference to the following drawings, in which:

FIG. 1 illustrates, in section, an open-end spinning rotor, in accordance with this invention, which is produced when two lathe-turned parts are connected to one another;

FIG. 2 illustrates, in section, one modification in accordance with this invention which includes a non-radial parting gap;

FIG. 3 illustrates, in section, another aspect of an open-end spinning rotor according to this invention, in which the rotor parts are connected to one another by means of flanges which are under prestress;

FIG. 4 illustrates, in section, a further modification of a spinning rotor with flanges of different thicknesses;

FIG. 5 illustrates, in section, a spinning rotor in accordance with this invention and produced from sheet metal by means of plastic shaping;

Like reference characters used throughout the specification and drawings refer to same or analogous elements.

DETAILED DESCRIPTION OF THE PREFERRED EMBODIMENTS

Figure 6:
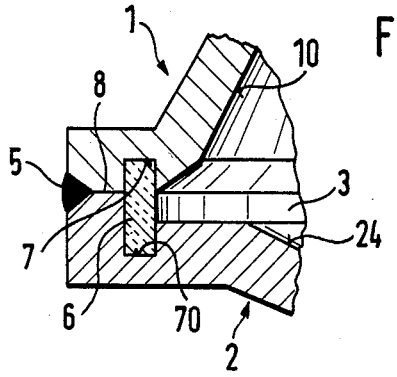
FIG. 6 illustrates, in section, a spinning rotor in accordance with a further aspect of this invention, in which an inserted insert ring radially limits the fiber-collecting groove.

The open-end spinning rotor illustrated in FIG. 1 comprises two rotor parts 1 and 2 which are connected to one another and which form a fiber-collecting groove 3 between them. Rotor part 1 has a sliding wall 11 which widens (or flares out) from the open rotor edge 10 to fiber-collecting groove 3, thereby defining a frustoconical inner contour of rotor part 1. Rotor part 2 constitutes the rotor bottom 24 and has a dish-shaped inner contour. It possesses a central bore 20, by means of which it is fastened on a rotor shaft 4. On the outside of the rotor, the spinning rotor (comprised of both rotor parts 1 and 2) has a wedge-shaped recess obtained by appropriate shaping of one or both of rotor parts 1 and 2. In this recess there is formed a weld seam 5, by which the two rotor parts 1 and 2 are connected to one another.

In the exemplary embodiment illustrated in FIG. 1, rotor parts 1 and 2 may be manufactured from bar stock by means of being cut into their final form. As a result of appropriate machining, they may also acquire any desired surface characteristics by means of polishing, coating or the like. This kind of finish machining is also known in connection with one-piece open-end spinning rotors.

The finished rotor parts 1 and 2 are abutted against one another at their respective larger diameters, and are then connected to one another by means of the weld seam 5 described above. Between rotor parts 1 and 2 there is a parting gap 8 which extends from weld seam 5 to where it ends in fiber-collecting groove 3, this gap is sufficiently narrow due to the previous machining of the rotor parts that no fibers or dirt constituents can become stuck in it. The welded joint which may be made by means of shielded arc welding, induction welding, or the like, guarantees that the parting gap also does not become larger, thus ensuring that tight gap conditions sufficient for fiber and dirt rejection are maintained.

During welding, the two rotor parts 1 and 2 are so arranged relative to the welding location and rotated past the welding location in such a way that weld seam 5 forms solely on the outside of the open-end spinning rotor, as shown in FIG. 1. Weld seam 5 thus does not intrude into the fiber-collecting groove 3, and therefore even later during dynamic activity, such as spinning, can have no adverse effects on the fibers subsequently deposited in fiber-collecting groove 3.

Precise orientation of parting gap 8 between rotor parts 1 and 2 is not essential. For example, while FIG. 1 illustrates that weld seam 5 and parting gap 8 adjacent to it are located mostly in a radial plane intersecting the spinning rotor, in FIG. 2 rotor part 2 has an annular shoulder 21, above which rises an annular projection 22. The larger diameter portion of rotor part 1 in FIG. 2 extends to shoulder 21 of rotor part 2. Since the outside surface of rotor part 1 is formed in parallel correspondence with sliding wall 11, a wedge-shaped parting gap 8 is formed between wall 12 and annular projection 22 which has essentially the form of a cylinder shell surface and is practically filled completely by weld seam 5. In this embodiment of the spinning rotor, the annular projection 22 offers particularly good resistance to deformation at high rotor speeds.

Referring to FIG. 3, rotor parts 1 and 2 possess radial flanges 13 and 23 respectively, by which rotor parts 1 and 2 are connected to one another. The two flanges 13 and 23 have a slight conicity, which is such that when the edges forming the fiber-collecting groove 3 rest on one another, the surfaces to be connected do not rest against one another, but instead form an annular gap 50 which widens in the outward direction (as repesented by broken lines in FIG. 3). While rotor parts 1 and 2 are being connected to one another by means of welding, these flange surfaces are pressed against one another with force applied as shown by arrows 51 until the two rotor parts 1 and 2 are connected to one another by formation of weld seam 5. Because of the presetress generated as a result of this type of connection, the edges of the two rotor parts 1 and 2 limiting fiber-collecting groove 3 are pressed firmly against one another, thus reliably preventing the formation of any chinks or gaps between rotor parts 1 and 2 in which fibers or dirt could become lodged.

As illustrated in FIG. 3, the two flanges 13 and 23 are of different thicknesses, with the flange 23 of rotor part 2 (constituting the bottom 24 of the spinning rotor) having a greater wall thickness "b" than rotor part 1 (associated with the sliding wall portion 11) which has a wall thickness "a". The rotor part 2 thus provides the finished open-end spinning rotor a high dynamic (dimensional) stability even at high speeds.

Furthermore, the fine balancing of the finished spinning rotor can be achieved with great simplicity by milling off material from the flange 23, without the necessity of this being done in the region adjacent the parting gap 8 filled by the weld seam 5. The flange 23 is sufficiently thick to tolerate this milling-off operation on its side facing away from the parting gap 8 while still providing necessary physical strengh. An exemplary such balancing milling-off line is illustrated by broken lines at 52 in FIG. 4.

A comparison of FIGS. 1 and 2 illustrates that the fiber-collecting groove 3 may have various forms, each within the scope of this invention. FIG. 5 further illustrates another exemplary spinning rotor, the rotor parts 1 and 2 of which have been produced from sheet metal by means of plastic shaping and which enclose between them an acute-angled fiber-collecting groove 3. This fiber-collecting groove 3 possesses an angle more acute than could be produced by conventional pressing and rolling tools. Although in the sheet-metal spinning rotor illustrated in FIG. 5 the abutting surfaces of the rotor parts 1 and 2 are relatively small, these rotor parts 1 and 2 are nonetheless connected to one another securely and permanently by means of weld seam 5 which fills parting gap 8 almost completely.

Particularly in open-end spinning rotors produced from sheet metal by non-cutting shaping, and also in many spinning rotors produced by means of cutting shaping (depending on the material from which rotor parts 1 and 2 are made), it is possible and expedient to produce the fiber-collecting groove 3 as a result of stamping. With stamping, the advantageous surface structure, which would be otherwise destroyed by machining, is preserved. At the same time, the stamping results in a compression of the material, which provides an increase in the wearing resistance of the material.

As illustrated in FIG. 4, an annular slot 30 is formed in rotor part 2 as a result of stamping, and after the two rotor parts 1 and 2 are joined inseparably to one another, this annular slot 30 comprises fiber-collecting groove 3. According to FIG. 3, angular annular slots 31 and 30 are respectively formed in rotor part 1 and in rotor part 2, and these together comprise the fiber-collecting groove 3 of that embodiment.

The fiber-collecting groove 3 of open-end spinning rotors is usually subjected to particuraly high wear. To lengthen the service life of such a spinning rotor, a further feature of this invention concerns an insert ring 6 which forms at least part of fiber-collecting groove 3 (see FIGS. 6 through 8). This insert ring may be formed, for example, as a ceramic part.

According to FIG. 6, coaxial annular slots 7 and 70, respectively, are provided in each of the two rotor parts 1 and 2, and have the same diameter. When the two rotor parts 1 and 2 are joined together, an insert ring 6 is inserted into both the annular slots 7 and 70 as they brought into line with one another, and is secured in that position by virtue of rotor parts 1 and 2 being connected to one another. The geometry of rotor parts 1 and 2 and of insert ring 6 is selected so that insert ring 6 provides radial limitation to fiber-collecting groove 3, with the side walls of fiber-collecting groove 3 being formed by rotor parts 1 and 2 as in some of the previous embodiments. At the same time, these side walls may take on differing forms in accordance with the invention.

Figure 7:
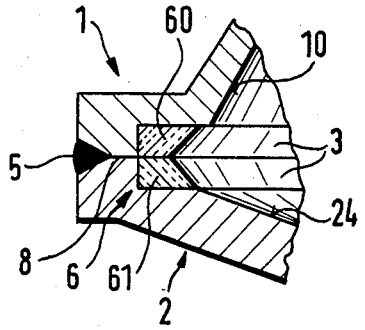
FIG. 7 illustrates, in section, a modification to the spinning rotor in which the insert ring includes profiling.

FIG. 7 shows a modification of the open-end spinning rotor illustrated in FIG. 6. In this exemplary embodiment, insert ring 6 is not arranged in annular slots 7 and 70, but instead in recesses which are formed in rotor parts 1 and 2 which open towards the rotor interior. These recesses constitute fiber-collecting groove 3 of this embodiment. So that the fiber-collecting groove 3 may with ease be manufactured in any desired form, the insert ring 6 is divided into two part rings 60 and 61 which are both then profiled in the desired formation. When rotor parts 1 and 2 are brought together, ring parts 60 and 61 are held against one another in the region of their largest inside diameter, and thereby together form fiber-collecting groove 3. Depending on the desired form of fiber-collecting groove 3, it is not necessary for both part rings 60 and 61 to have the same maximum inside diameter, as is illustrated by a comparison of FIGS. 2 and 4.

Insert ring 6 has its form determined before it is inserted between rotor parts 1 and 2 constituting the open-end spinning rotor. This profiling of the inner peripheral surface of insert ring 6 according to the desired cross-section of fiber-collecting groove 3 is carried out for this invention in differing ways according to the type and thickness of material.

Figure 8:
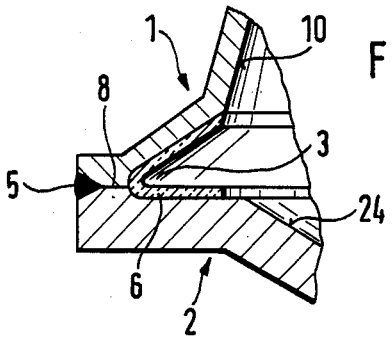
FIG. 8 illustrates, in section, a further modification of an open-end spinning rotor according to this invention, in which the insert ring comprises rolled sheet metal.

FIG. 8 illustrates a sheet-metal spinning rotor which accommodates an insert ring 6 likewise consisting of sheet metal. This insert ring 6 may comprise wear-resistant spring steel or the like and may be formed conventionally in the desired shape by rolling. It is possible in this manner for the final form of fiber-collecting groove 3 to be defined only when the two rotor parts 1 and 2 are joined together and connected, with the prestress thus generated causing the ends of insert ring 6 to rest closely against the inner walls of rotor parts 1 and 2, thereby preventing fibers and dirt constituents from becoming jammed therein. Especially acute-angled forms of fiber-collecting groove 3 are possible as a result, since the final form is only obtained when the two rotor parts 1 and 2 are connected to one another by means of weld seam 5. A similar insert ring 6 comprising sheet metal may of course also be used with rotor parts 1 and 2 formed in other ways such as lathe-turned parts.

An open-end spinning rotor in general accordance with the features of the apparatus and process of this invention may undergo many other modifications and variations, all of which likewise come within the scope of the present invention. These include, but are in no way limited to, the interchange of features or their replacement by equivalents. For further example, depending on the desired material, rotor part 1 may comprise sheet metal while rotor part 2 is produced as a lathe-turned steel part, or vice versa. The two rotor parts 1 and 2 may comprise different materials, so long as their capacity for being welded together is not thereby impaired. Likewise, open rotor edge 10 may also receive a suitable thickening 14 (FIG. 4). All such modifications and variations which would occur to one of ordinary skill in the art while practicing the present invention are intended to fall within the scope of the present invention, which is further defined by the appended claims.

What is claimed is:

1. An open-end spinning rotor, comprising:
first and second rotor parts which abut each other and form a parting gap therebetween, said parting gap opening into a fiber-collecting groove; and
welding material, deposited in a portion of said gap, defining a weld seam which joins said two rotor parts.

2. An open-end spinning rotor as in claim 1 wherein said parting gap opens radially into said weld seam.

3. An open-end spinning rotor as in claim 2, wherein said two rotor parts each have a respective radial flange, and said parting gap is formed between said flanges.

4. An open-end spinning rotor as in claim 3, wherein
said first rotor part has a sliding wall for the deflection of fibers, and
said second rotor part comprises a bottom of said rotor, and wherein
the flange thickness of said second rotor part is greater than the flange thickness of said first rotor part.

5. An open-end spinning rotor as in claim 4, wherein said parting gap is formed by surfaces of said flanges which are, without application of any force thereto, non-parallel with respect to each other, but the surfaces of which facing said fiber-collecting groove are held in parallel against one another under prestress by said weld seam.

6. An open-end spinning rotor as in claim 4 wherein at least part of said fiber-collecting groove is defined by an insert ring which adjoins said sliding wall, is fixedly positioned between said first and second rotor parts and limits said parting gap in a radially inward direction therefrom.

7. An open-end spinning rotor as in claim 6 wherein said insert ring comprises ceramic material.

8. An open-end spinning rotor as in claim 6 wherein said first and second rotor parts have respective coaxial annular slots aligned with one another for receiving and fixedly positioning said insert ring between said rotor parts.

9. An open-end spinning rotor as in claim 6 wherein said insert ring is profiled along its inner periphery.

10. An open-end spinning rotor as in claim 9, wherein said insert, ring comprises two part rings abutting one another.

11. An open-end spinning rotor as in claim 10, wherein said two part rings abut one another along their respective largest inside diameter.

12. An open-end spinning rotor as in claim 6 wherein said insert ring comprises profiled sheet metal held against said first and second rotor parts under prestress by virtue of said weld seam joining said two rotor parts.

13. An open-end spinning rotor as in claim 6 wherein said insert ring defines an acute angle so as to form an acute-angled fiber-collecting groove.

14. An open-end spinning rotor as in claim 1 wherein said fiber-collecting groove comprises an angular annular slot which is stamped in at least one of said first and second rotor parts.

15. An open-end spinning rotor as in claim 1, wherein:

said first rotor part defines a sliding wall for deflecting fibers towards said fiber-collecting groove; and said second rotor part defines an annular shoulder for supporting an end surface of said sliding wall, and defines an annular projection which is continguous with but radially outward from said annular shoulder; and further wherein said parting gap is formed between said sliding wall end surface and said annular shoulder, and opens radially inward into said fiber-collecting groove; and said weld seam is formed between a radially-interior side wall of said annular projection and a radially-exterior side wall of said sliding wall.

16. An open-end spinning rotor as in claim 1 wherein said rotor parts which form said angled fiber-collecting groove define an acute-angled fiber-collecting groove.

17. A process for making an open-end spinning rotor, comprising the steps of:

separately forming first and second rotor parts;

bringing together substantially in parallel respective surfaces of said rotro parts so as to define an interior fiber-collecting groove; and forming a weld seam about an exterior portion of said rotor parts to join the same whereby said weld seam is restricted to the exterior portion of said rotor parts.

18. A process as in claim 17 wherein said surfaces are respectively non-parallel prior to said bringing together step, which step therefore places said rotor parts in a degree of prestress.

19. A process as in claim 17 wherein said forming step includes the step of producing said first rotor part by non-cutting forming such that it defines a sliding wall portion for deflecting fibers into said fiber-collecting groove, and forming the portion of the first rotor part contributing to the defining of said groove by stamping.

20. A process as in claim 17, further comprising the steps of:

providing opposing annular recesses in the rotor parts; and securing an insert ring into the recesses during said bringing together step, whereby the insert ring is secured between the rotor parts and provides a radially outward limit on the interior fiber-collecting groove.

* * * * *